United States Patent [19]

Okada

[11] Patent Number: 4,741,532

[45] Date of Patent: May 3, 1988

[54] REEL DRIVE DEVICE FOR SLOT MACHINE

[75] Inventor: Kazuo Okada, Tokyo, Japan

[73] Assignee: Kabushiki Kaisha Universal, Tochigi, Japan

[21] Appl. No.: 516,276

[22] Filed: Jul. 22, 1983

[30] Foreign Application Priority Data

Jul. 26, 1982 [JP] Japan ..... 57-112184[U]

[51] Int. Cl.[4] ..... A63F 5/04

[52] U.S. Cl. ..... 273/143 R; 464/81; 464/100

[58] Field of Search ..... 273/143; 464/61, 62, 464/66, 67, 84, 100, 101, 81

[56] References Cited

U.S. PATENT DOCUMENTS

| | | | |
|---|---|---|---|
| 747,250 | 12/1903 | Smith | 464/62 |
| 851,189 | 4/1907 | Wagner | 464/62 |
| 1,180,695 | 4/1916 | Carlson | 464/62 |
| 2,622,215 | 12/1952 | Piekarski et al. | 464/61 X |
| 4,410,178 | 10/1983 | Partridge | 273/143 R |

FOREIGN PATENT DOCUMENTS

| | | | |
|---|---|---|---|
| 473277 | 10/1937 | United Kingdom | 464/61 |
| 898155 | 1/1982 | U.S.S.R. | 464/84 |

*Primary Examiner*—Paul E. Shapiro
*Attorney, Agent, or Firm*—Young & Thompson

[57] ABSTRACT

A reel of a slot machine is rotatably fitted on a shaft of a motor and coupled to the shaft by an elastic member. When the motor is started, energy is stored in the elastic member, and the reel is suddenly caused to start rotation at a high speed by the energy stored in the elastic member. A projection on the reel engages a drive lever to fix the relative position of the parts after the initial period of relative movement of the shaft and reel. The elastic member can be a coil tension spring or a leaf spring sandwiching the drive lever, a portion of the leaf spring on the rear side of the lever being secured to the reel.

1 Claim, 1 Drawing Sheet

REEL DRIVE DEVICE FOR SLOT MACHINE

BACKGROUND OF THE INVENTION

This invention relates to a slot machine with reels driven by motors and, more particularly, an improved reel drive machine which can cause the reels to suddenly start rotation at a high speed after slight delay period from the start of motors.

In usual prize-winning game slot machine, a plurality of juxtaposed reels each having a plurality of symbol patterns provided on the outer periphery at a predetermined pitch are simultaneously caused to start rotation by pulling a handle after inserting a given number of coins or tokens into a coin slot. After the start of their rotation, the individual reels are successively brought to a stop by depressing respective stop buttons or after the lapse of periods determined by random timers. When all the reels are stopped, a combination of symbol patterns on the respective reels is obtained on a symbol display window line. If this symbol pattern combination is a prize-winning one, a number of coins corresponding to the probability of occurrence of this combination are paid out from a pay-out slot.

In the most general slot machine of this kind, kick levers are provided for the respective reels and are operated by the handle to cause the rotation of reels. Recently, slot machines of motor drive type, in which the reels are secured to the shafts of respective pulse motors, have become available on the market. In this type of slot machine using pulse motors, the start and stop of the reel rotation are controlled solely by the pulse motors. Also, the positions, at which the reels are brought to a halt, can be detected through the counting of pulses supplied to the pulse motors. The machine thus can be simplified in construction and be provided at a reduced cost.

Generally, the pulse motor starts rotation with a lowest initial speed, which is gradually increased to reach a constant speed. The reel driven by the pulse motor is thus started slowly. On the other hand, in the slot machine of the mechanical drive type using the kick levers, the reel is driven by an impact force applied by kicking it. That is, its rotation can be started at a high speed from the outset. The history of the slot machine of the mechanical drive type is quite long, and there is a strong concept that the high initial speed start noted above is the regular mode of operation of the slot machine. Conceptionally, therefore, it is desirable that the slot machine of the motor driven type be started in the same mode of starting as in the slot machine of the mechanical drive type, i.e., the reels be caused to start rotation at a high initial speed.

OBJECTS OF THE INVENTION

The primary object of the invention is to provide a reel drive device, which permits a high speed start of rotation of reels.

Another object of the invention is to provide a reel drive device, in which each motor is always stopped with a constant relation between the stopped positions of the motor shaft and reel.

A further object of the invention is to provide a reel drive device, which can cause high speed start of reels with a simple construction.

SUMMARY OF THE INVENTION

The above and other objects, features and advantages of the invention are attained by a structure, in which a reel is rotatably fitted on a shaft of a motor, a drive lever is secured to the motor shaft and the drive lever and reel are elastically coupled together by an elastic member such as coil spring. During an initial period after the start of the motor, the reel is not rotated by the motor shaft, but the motor torque is stored as a restoring force in the elastic member, and the start of rotation of the reel is caused by the stored energy. Thus, the reel is started at a far higher initial rotational speed than that of the motor.

According to the invention, the reel is thus started at a high speed a slight delay time after the start of the motor. In addition, since the reel is not secured to the motor shaft, it can be readily removed so that its inspection, service and replacement can be done efficiently. Furthermore, during the initial period after its start, the motor only serves the role of gradually storing restoring force in the elastic member. This means that the load torque is greatly reduced compared to the case of a system where the reel is fixedly coupled to the motor shaft.

DETAILED DESCRIPTION OF THE INVENTION

Figure 1:
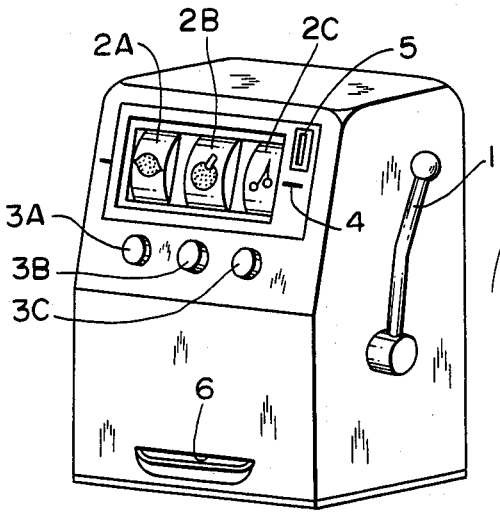
FIG. 1 is a perspective view showing a slot machine.

Referring now to FIG. 1, there is shown a slot machine, in which individual pulse motors are started by pulling a handle 1 toward the player. Reels 2A to 2C are simultaneously caused to rotate after a slight delay from the start of the pulse motors. The reels 2A to 2C are stopped by pulse motor stop signals which are generated by depressing stop buttons 3A to 3C. The determination of the combination of symbol patterns of the reels that results when the reels are stopped, is done through the counting of drive pulses given to the pulse motors during one rotation of the reels and reference to a table memory in which the relation between count signals and symbol patterns is stored. Coins are inserted through a coin slot 5 before starting the game. Coins corresponding in number to a pay-out number are paid out through a pay-out slot 6.

Figure 2:
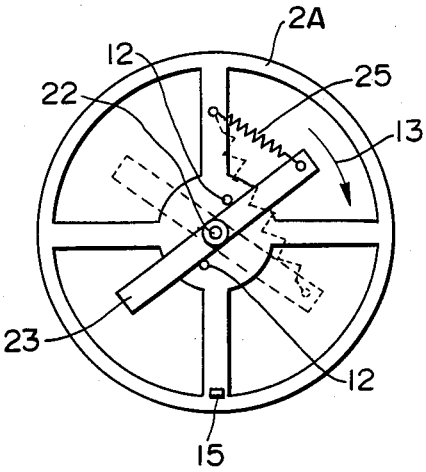
FIG. 2 is a side view showing an embodiment of the invention, in which a reel and a drive lever are coupled together by a coil spring.
Figure 3:
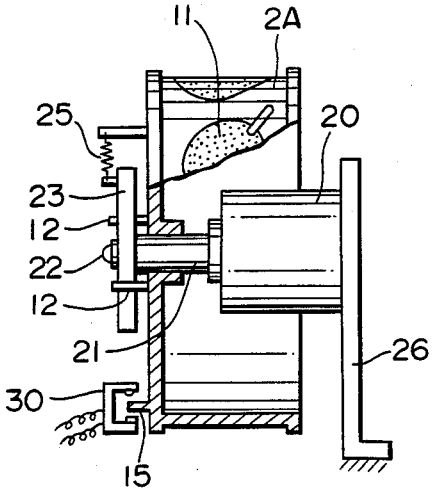
FIG. 3 is an elevational view, partly in section, showing the embodiemnt of FIG. 2, a reel thereof being partly shown.

FIGS. 2 and 3 show an embodiment of the invention, in which a coil spring is provided between each reel and drive lever. The description will now be made by taking the reel 2A as an example. The reel 2A has several symbol patterns 11 provided on its outer periphery at a predetermined interval. The reel 2A is rotatably fitted on a shaft 21 of a pulse motor 20. A drive lever 23 is secured by means of a nut 22 to the shaft 21. The pulse motor 20 is secured to an arm 26 which is in turn secured to the frame of the slot machine. A stopper pin 12 projects from the reel 2A such that it can engage the drive lever 23. The reel 2A and drive lever 23 are coupled together by a coil spring 25. The reel 2A has a reference signal piece 15, which is provided for discriminating the symbols on the reel. Every time the reference signal piece 15 passes through a gap in a photosensor 30, which is secured to the frame of the slot machine, a reference signal is produced from the photosensor 30. The reference signal is used for resetting a counter (not shown) for counting drive pulses. When the handle 1 is pulled, a drive pulse is supplied to the pulse motor 20. As a result, the shaft 21 of the pulse motor 20 is rotated in the direction of arrow 13. During an initial period of the rotation of the shaft 21, however, the reel 2A is not started, but the torque is stored in the coil spring 25 via the drive lever 23. When the drive 23 is rotated up to a position shown by dashed lines in FIG. 2, the restoring force stored in the coil spring 25 in the illustrated state thereof supasses the inertia of the stationary reel 2A, whereupon the reel 2A is caused to rotate suddenly by the tension in the coil 25. The rotational speed of the reel 2A having thus started to rotate is slightly higher than the rotational speed of the pulse motor shaft, i.e., the drive lever 23, so that the stopper pin 12 of the reel 2A eventually comes into engagement with the drive lever 23. Subsequently, the reel 2A and drive lever 23 are rotated in contact with each other with the rotation of the pulse motor shaft under the action of the coil spring 25, whereby a constant rotational speed sets in. When the constant speed rotation of the reel 2A has set in, the operation of the stop buttons 3A to 3C is now effective to stop the reels. When the stop button 3A is depressed, no drive pulse is supplied any more to the pulse motor 20, so that the pulse motor 20 is brought to a stop. In this state, the stopper 12 of the reel 2A and drive lever 23 are held in contact with each other by the tension in the coil spring 25. The moment when the pulse motor 20 comes to a halt, the stopper pin 12 is slightly pushed back against the tension in the coil spring 25 by the reaction force of the drive lever 23 against the momentum of the reel 2A, but the illustrated stationary state is eventually brought about again by the tension in the coil spring 25. Subtle changes in the position, at which the reel 2A comes to a halt, thus can be provided by suitably selecting the materials of the stopper pin 12 and drive lever 23, either rigid of elastic.

The use of the pulse motors as reel drive sources as in the above embodiment is advantageous in that the displayed symbols of the reels when the reels are stopped can be readily discriminated through the counting of drive pulses or pulses obtained during inertial rotation subsequent to the appearance of a stop signal and also that the pulse motor has such a structural feature that the motor can be stopped at regular positions corresponding to the display positions of the symbol patterns. However, according to the invention it is possible to use ordinary motors instead of the pulse motors.

Figure 4:
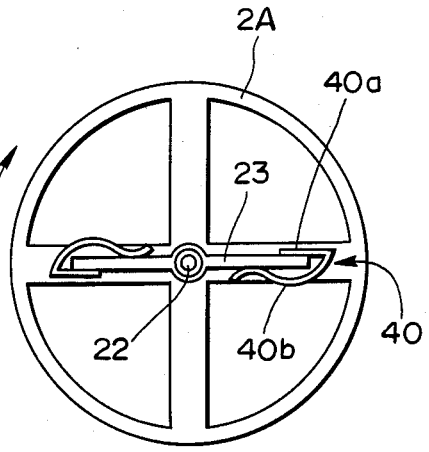
FIG. 4 is a side view showing a different embodiment of the invention.

FIG. 4 shows a different embodiemnt of the invention, in which leaf springs are used. In the Figure, the parts corresponding to those in FIGS. 2 and 3 are designated by like reference numerals. In this instance, paired leaf springs 40 are provided on one side of reel 2A. These leaf springs 40 each have a stationary portion **40*a* and an elastic portion 40*b*. The stationary portion 40*a* has its entire length secured to the reel 2A, and it has the same role as the pin 12 shown in FIG. 2. The elastic portion 40*b* has the character of a spring and serves the same function as the coil spring 25 shown in FIG. 2. During an initial period after the start of the reel 2A, the elastic portion 40*b* is flexed. During the normal rotation of the reel 2A and also when the reel 2A is brought to a stop, drive lever 23 is held in a fixed position relative to the reel 2A by the leaf springs 40. The leaf springs 40 may be desirably formed from a metal sheet or a synthetic resin sheet. This is so from the standpoint of the effectiveness of the spring action. Where a synthetic resin is used, both the leaf springs 40 and reel 2A** may be formed as a one-piece molding. By so doing, the number of parts can be reduced to further improve the adaptability to mass production.

While the above embodiments have been described as preferred forms of the invention, they are by no means limitative, and various changes and modifications can be made without departing from the scope and spirit of the invention.

What is claimed is:

1. In a slot machine having a plurality of juxtaposed reels each having a plurality of symbol patterns arranged along the outer periphery and driven from a motor;

a reel rotatably fitted on a shaft of said motor;

a drive lever secured to and radially extending from said motor shaft; and elastic means coupling said reel and drive lever and capable of storing energy with the start of said motor to cause said reel to be suddenly rotated by the restored energy; the improvement in which:

said elastic means is leaf spring means sandwiching said drive lever, portions of said leaf spring means on the back side of said drive lever being secured to said reel.

* * * * *